United States Patent [19]

Kell

[11] Patent Number: 4,740,181

[45] Date of Patent: Apr. 26, 1988

[54] WATER SKIING TOW BRIDLE CONSTRUCTION

[76] Inventor: John Kell, P.O. Box 6134, Canyon Lake, Calif. 92380

[21] Appl. No.: 17,523

[22] Filed: Feb. 24, 1987

[51] Int. Cl.[4] ..... A63C 15/06

[52] U.S. Cl. ..... 441/69

[58] Field of Search ..... 441/69; 272/61, 143; 16/111 R, 125; 403/285

[56] References Cited

U.S. PATENT DOCUMENTS

| | | | |
|---|---|---|---|
| 296,713 | 4/1884 | Turner | 16/111 R |
| 3,092,068 | 6/1963 | Brownson | 441/69 |
| 3,130,443 | 4/1964 | Tonelli | 403/285 X |
| 3,930,460 | 1/1976 | Beck | 441/69 |
| 4,263,685 | 4/1981 | Neuscheler | 441/69 |
| 4,374,638 | 2/1983 | Presser | 441/69 |

FOREIGN PATENT DOCUMENTS

| | | | |
|---|---|---|---|
| 717428 | 10/1954 | United Kingdom | 403/278 |

*Primary Examiner*—Sherman D. Basinger

*Attorney, Agent, or Firm*—Poms, Smith, Lande & Rose

[57] ABSTRACT

A one-piece tow bridle for water skiing has a rigid, elongated metal handle part forming the base of an isosceles triangle, with an elongated metal member, e.g., a length of stainless steel cable, forked at a mid point to extend rearwardly in the legs of the triangle, each leg having an end swaged into an end of the handle part, with the whole assembly being encapsulated in a closed-cell foam rubber covering. Various embodiments of the swaging connection are presented, as is a kit for retrofitting an existing handle with the improved bridle.

5 Claims, 3 Drawing Sheets

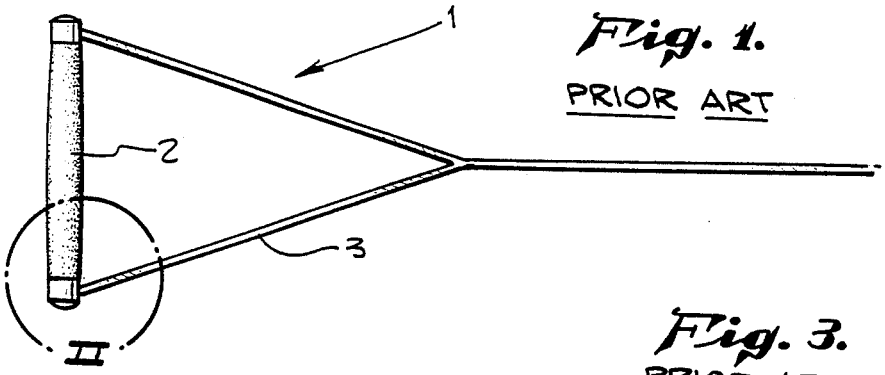
Fig. 1.
PRIOR ART
Fig. 2.
PRIOR ART
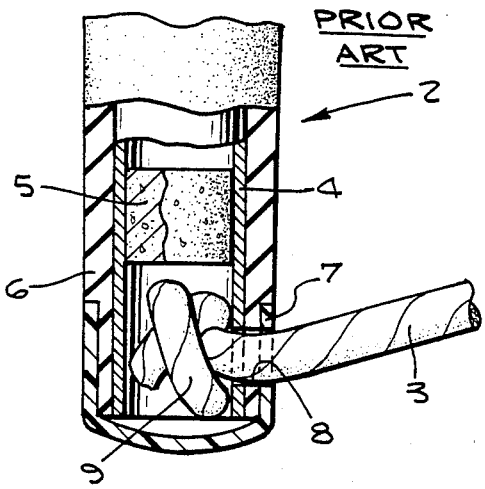
Fig. 3.
PRIOR ART
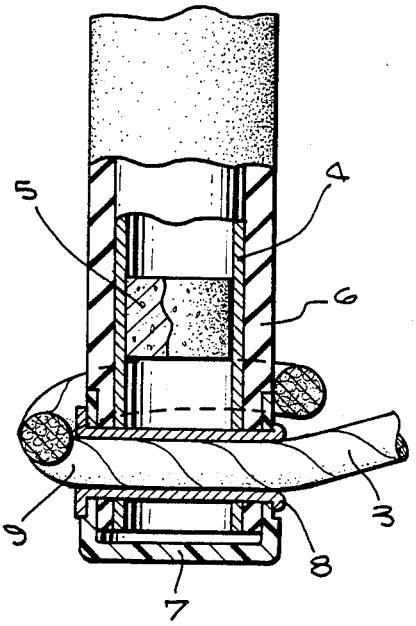
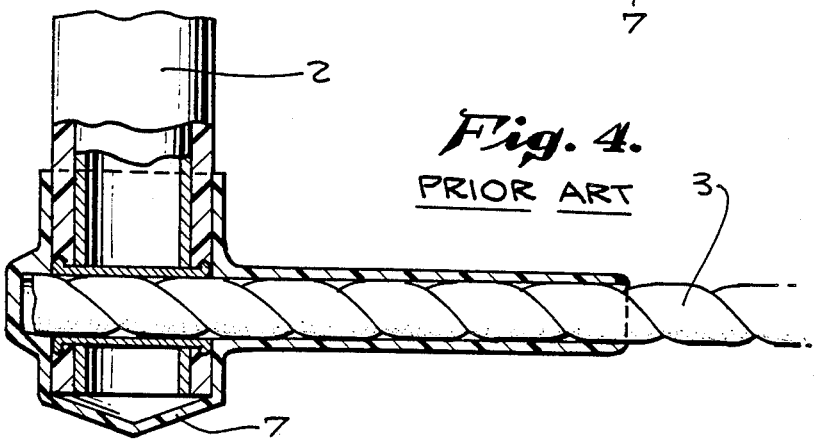
Fig. 4.
PRIOR ART

WATER SKIING TOW BRIDLE CONSTRUCTION

BACKGROUND OF THE INVENTION

1. Field of the Invention

This invention pertains, in general, to sports and athletic equipment, and in particular, to an improved water ski tow bridle and handle.

2. Description of the Related Art

A tow bridle for water skiing typically comprises one or a pair of elongated cylindrical handles, which may be made of wood, and which contain a pair of transverse through holes located at either end. A loop of tow rope, typically stranded polypropylene, has ends which extend through, or into, the handle and are knotted to hold the rope to the handle. The balance of the tow rope attaches to the loop at its midpoint and extends forward to attach to a tow boat.

This simple handle/bridle arrangement has a number of problems which various practitioners have, over the years, attempted to address.

Once such problem is that wooden handles have a hard surface which is difficult to grasp when the handle is wet. Additionally, the wood tends to crack and split when repeatedly exposed to moisture. Also, the ends of the handle tend to be hard and can cause painful injury if they strike the skier while moving with some velocity. An effort to address some of these problems is the handgrip of Brownson in U.S. Pat. No. 3,092,068 in which the wooden handle is replaced by hollow-core aluminum tube having stoppers in the ends to seal the tube for flotation, a soft, cellular foam coating around the handle for gripping comfort and a pair of soft endcaps to protect the skier against impacts by hard, sharp ends of the tube.

Another problem encountered with such handles is the fraying that can occur at the point where the rope enters the handle, coupled with the abrasion or pinching of the fingers of the skier which can occur when the skier's hands are placed on the handle toward either end, particularly during hard turns. An effort to overcome some of these problem may be found in the end caps and handle construction of Rumbaugh in U.S. Pat. No. 4,060,049.

Another common problem with water ski tow handles and bridles is the fraying and the subsequent parting of the tow rope which commonly occurs between the handle and the rope just ahead of the attachment knot during hard use of the handle. In an effort to overcome this common problem, skilled practitioners have taken to threading the rope through the handle and forming a loop about the handle with it, then recirculating the end of the rope back through the handle and splicing it into the core of the rope to retain the rope by means of the "Chinese handcuff" method. Such an attachment configuration is described in U.S. Pat. No. 3,930,460 to Beck, wherein a length of heat shrinkable tubing is applied over a sleeve of rubber directly adjacent to the handle to insure that the braided rope always retains some grip on the portion of rope inserted into it and to provide protection for the hands of the skier.

Another variation on this looping technique is described in Brownson in U.S. Pat. No. 3,537,418.

Yet another recirculating loop attachment is illustrated in Pittman, U.S. Pat. No. 4,335,478, in which a protective end cap having a molded, elongated sleeve attached to it is provided to snap over each end of the handle and the bridle rope at the point of attachment.

Another variation on the recirculating rope loop attachment method is shown in U.S. Pat. No. 4,043,290 to Holland, in which a sleeve is formed integrally with the handgrip and has a hole extending transversely therethrough such that the towline loop encircles the grip through the corresponding sleeve hole.

A handgrip having a triangular cross-section and utilizing the looped tow rope to encircle the handgrip is illustrated in U.S. Pat. No. 4,182,258 to Presser.

Two further variations of the loop rope and protector sleeve attachments are shown in U.S. Pat. Nos. 4,540,371 and 4,585,420, both to Taylor.

A shock-absorbing water ski tow handle which floats and which eschews the looped-rope attachment method is illustrated in U.S. Pat. No. 3,695,210 to Stein, wherein a pair of tapered pins are utilized to attach the rope to the handle.

Presser, In U.S. Pat. No. 4,374,638, discusses a ski tow arrangement in which looped rope ends are retained within the ski handle by means of a pair of flat, T-shaped retainer clips having projecting barbs embedded into a wooden core.

While each of the foregoing references represents a valuable contribution to the water ski tow bridle art, some problems associated with the "weak link" of the assemblage, namely, the tow rope attachment, still remain. Thus, the simple knot at the end of the rope is subject to continuous wear, and seldom lasts for a season of heavy skiing. The looping method partially eliminates the fraying problem, but is relatively labor intensive to implement and, unless skillfully done, can prove to be unreliable, particularly during hard competition use.

It is, therefore, an object of the present invention to provide a water skiing tow bridle, including handle, which is strong and reliable enough to be well-suited for professional use and which completely eliminates the rope breakage problem, yet which is simple and inexpensive to fabricate and assemble.

It is a further object of the present invention to provide such a bridle which is comfortable to grip, relatively impact-safe, and which eliminates the finger pinching and abrasion problem of the prior art devices.

SUMMARY OF THE INVENTION

These, and other objects and advantages of the present invention, are preferably accomplished by the provision of a single-piece water skiing tow bridle comprising an elongated handle part which includes a metal rod or tube having two end portions bent parallel to each other and generally at right angles relative to the handle and extending outwardly therefrom for a short distance, the end portions having axial bores extending thereinto for a short depth. An elongated member, such as a metal rod or length of stainless steel cable is deformed at a mid portion to define two rearwardly-extending legs, each leg terminating in an end portion which is inserted into one of the bores in the metal rod of the handle, the metal rod then being swaged tightly about the elongated member's end portions in a permanent attachment. The whole affair is then encapsulated in a soft, closed-celled foam rubber material to provide slip resistance and finger comfort. Alternative embodiments provide a closed loop at the midpoint of the elongated member, a wooden dowel encircling the bar or rod of the handle, and a version which includes swage fitting which can be provided as a kit for retrofitting an existing, conventional handle to the improved configuration.

Skilled practitioners will obtain a more complete understanding from a consideration of the following detailed description of the preferred embodiment and the drawings appended hereto, a brief description of which now follows.

BRIEF DESCRIPTION OF THE DRAWINGS

FIG. 1 illustrates a prior art water ski bridle, including a handle within which a detail section II is taken;

FIG. 2 is an enlarged detail of the prior art handle of FIG. 1, as revealed by the detail II taken therein;

FIG. 3 is an alternate embodiment of a prior art handle showing a looped-rope attachment;

FIG. 4 is yet another prior art handle showing an end cap with protector sleeves;

DESCRIPTION OF THE PREFERRED EMBODIMENTS

Figure 10:
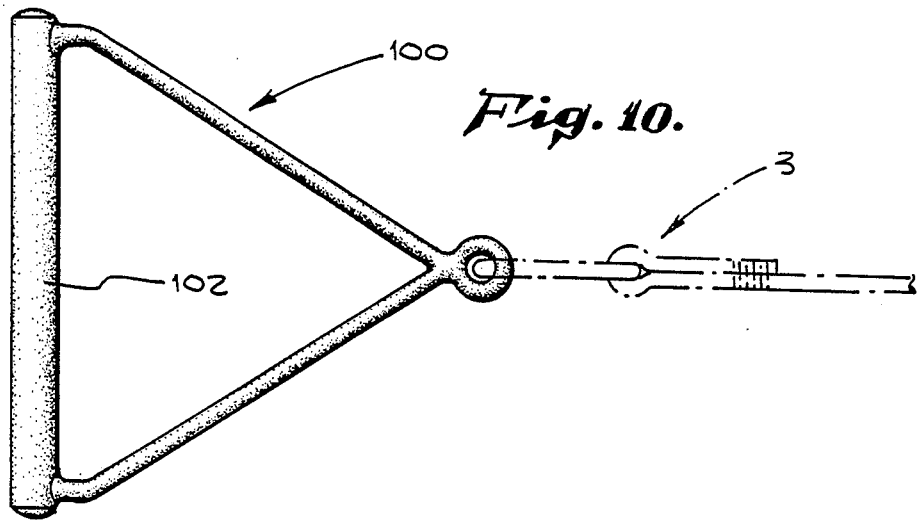
FIG. 10 is a second exemplary preferred embodiment of a handle in keeping with the present invention.

FIGS. 1–4 are illustrative of the water ski tow bridles and handles of the prior art discussed above.

FIG. 1 illustrates generally a prior art bridle 1 comprising an elongated handle part 2 and a stranded, forked or bifurcated polypropylene ski rope 3 extending forward for attachment to a tow boat.

FIG. 2 is a detail view into one of the ends of the prior art handle 2 of FIG. 1 in which an elongated tube 4 is plugged for flotation by means of a stopper 5 and is overcoated with a foamed rubber covering 6 for safety and gripping comfort. A protective plastic end cap 7 has an aperture 8 therethrough coinciding with apertures in tube 4 and covering 6 to permit insertion of bridle rope 3 into the end portion of handle 2, where rope 3 is knotted with a conventional knot 9. This form of attachment of rope 3 to handle 2 is quick and convenient, but is a source of hard abrasion and wearing on rope 3, particularly in the regions where rope 3 and end cap 7 or tube 4 are in wearing contact with each other.

FIG. 3 is another prior art handle similar to that illustrated in FIG. 2 except that rope 3 is passed through a reinforcing sleeve 8 extending transversely through handle 2 and is looped about the handle in an effort to eliminate some of the fraying problems associated with the knotting technique illustrated in FIG. 2.

FIG. 4 is another prior art bridle in which a handle 2 has an end cap 7 adapted to cover the loop 9 of rope 3, and includes an elongated, flexible protector sleeve extending laterally therefrom to cover the portion of rope 3 adjacent to the skier's fingers.

Figure 5:
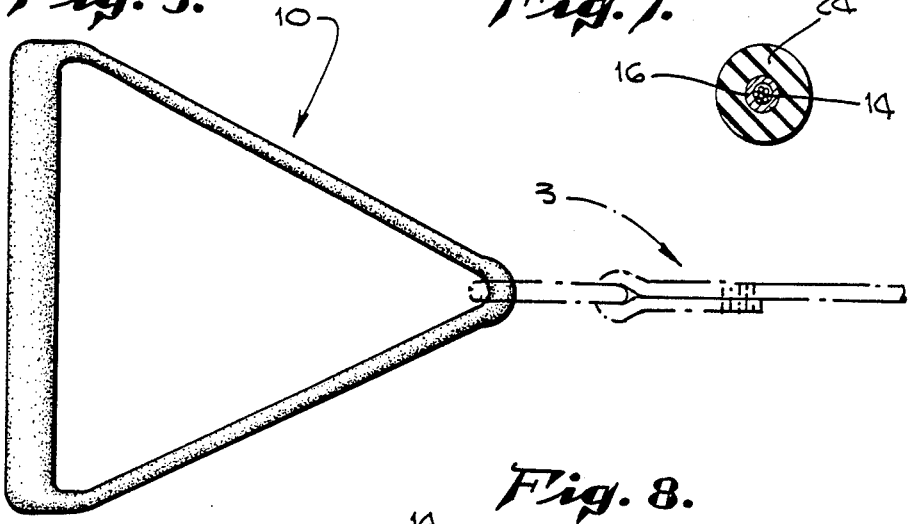
FIG. 5 is a first preferred exemplary embodiment of a water ski tow bridle, including handle, in keeping with the subject of the present invention.
Figure 7:
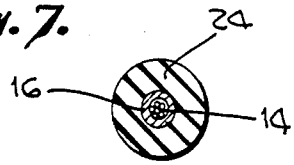
FIG. 7 is a sectional view through the bridle of FIG. 6, as revealed by the section VII—VII taken therein.
Figure 8:
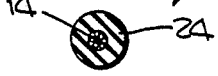
FIG. 8 is another sectional view into the bridle of FIG. 6, as revealed by the section VIII—VIII taken therein.

FIG. 5 illustrates an exemplary first preferred embodiment of a water ski tow bridle 10 in keeping with the subject of the present invention.

Figure 6:
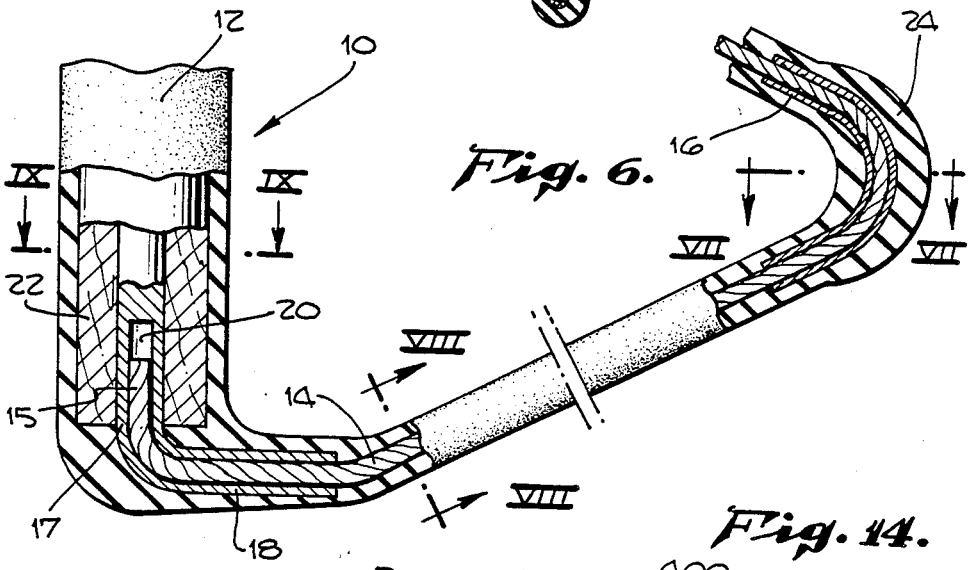
FIG. 6 is an enlarged, detailed sectional view into the handle of the first preferred embodiment.
Figure 9:
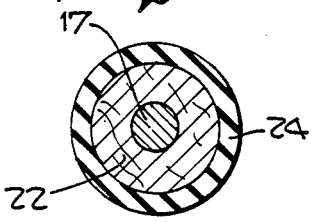
FIG. 9 is another detailed section through the handle part of the bridle of FIG. 6, as revealed by the section IX—IX taken therein.

An enlarged detail through the handle of the first preferred embodiment 10 is illustrated in FIG. 6, and includes a rigid, elongated handle part 12 having a long axis forming the base of an isoceles triangle and a pair of oppositely-directed ends. Attached to the ends of handle part 12 is an elongated member 14 which is forked or formed about a midpoint to define two rearwardly-extending legs of the triangle, each leg having an end portion swaged to an end of handle 12.

In the first exemplary preferred embodiment, elongated member 14 comprises either a bent metal rod, such as stainless steel or a heat treated aluminum alloy, e.g., 6061-T6, or preferably, a length of stainless steel cable.

Elongated member 14 is reinforced for attachment to ski rope 3 by means of a cylindrical sleeve 16 which is disposed about elongated member 14 at its midpoint and bent or formed simultaneously with the formation of elongated member 14 to reinforce attachment of bridle 10 to ski rope 3 by means of a simple loop or plastic clip at the end of tow rope 3.

In order reliably to swage ends 15 of elongated member 14 to ends of handle 12, the handle is provided with an integral, elongated metal rod 17 (preferably stainless steel or aluminum) having a pair of end portions 18 bent parallel to each other and transversely to handle 12 and extending outwardly from handle 12 for a short distance about equal to the thickness of a hand. Each end portion 18 has an axial bore 20 extending thereinto for a depth and into which end portions 18 of elongated member 14 are inserted during assembly. End portions 18 of rod 17 are then swaged firmly about end portions 15 of elongated member 14 to provide a strong, reliable and non-fraying attachment.

In order to provide gripping comfort, handle 12 further includes a wooden or plastic dowel 22 disposed coaxially about rod 17 between end portions 18, and the entire assembly is encapsulated with an overcoat of closed-celled or open-celled rubber foam. Dowel 22 may be cylindrical or triangular in cross-section, or may be fluted along its length to provide finger separation, and may be installed over rod 17 prior to end portions 18 being bent laterally, or may be split in half to facilitate assembly about rod 17 after end portions 18 have been formed transversely to the long axis of handle 12.

Figure 11:
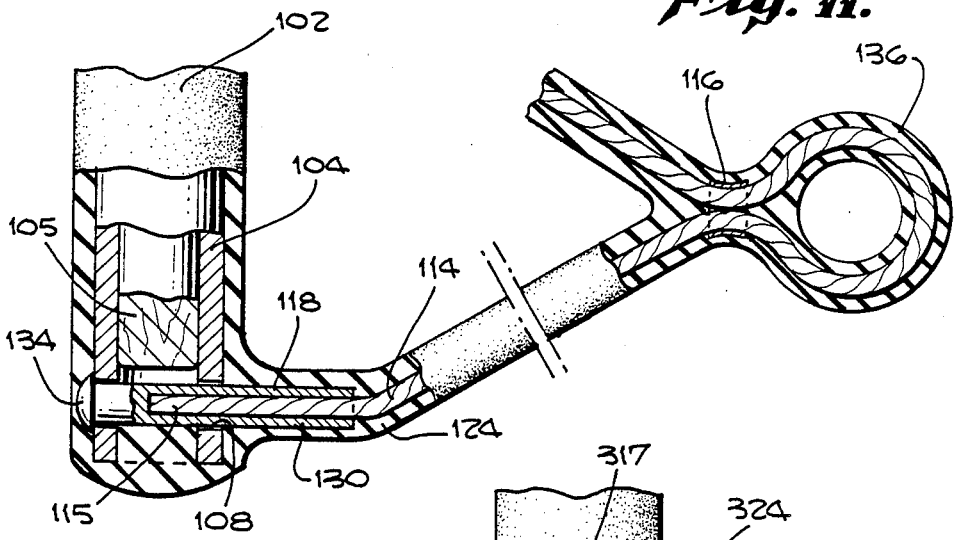
FIG. 11 is an enlarged, detail sectional view into the second exemplary preferred embodiment of FIG. 10.

FIG. 10 is illustrative of a second preferred embodiment of a bridle 100 made in accordance with the present invention. FIG. 11 is an enlarged, sectional detail through the second embodiment and includes a handle 102 having elements similar to the prior art handle 2 of FIG. 2, including an elongated cylindrical tube part 104 having a rubber or wooden dowel plug 105 for flotation. Handle 102 additionally has a pair of transverse holes or bores 108 located at either end of the handle. A swage fitting 130 having a head part 134 at one end is inserted through transverse hole 108 at either end of handle part 102 to extend laterally out the side of handle 102 for a short distance. The end portion 118 protruding from handle 102 has an axial bore 120 therein into which end portions 115 of elongated member 114 are inserted for swaging.

The second embodiment 100 also includes a closed loop for attachment to tow rope 3. If elongated member 114 consists of a formed, elongated rod, closed loop 136 may comprise nothing more than a radiused loop formed into the mid portion of the rod; or if elongated member 114 comprises stainless steel cable, for example, closed loop 136 may be formed and held in shape by means of a simple crimp fitting 116 crimped in place after open loop 136 has been formed. As in the first preferred embodiment, the handle and bridle assembly is ultimately encapsulated entirely in a foam rubber coating 124 for comfort, flotation and safety reasons.

Figure 12:
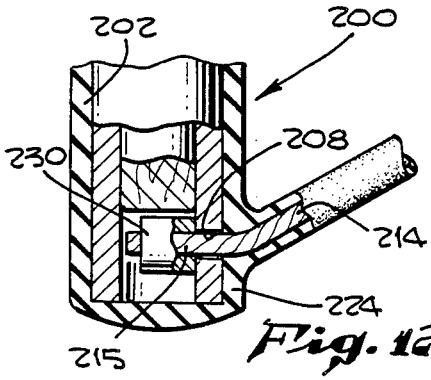
FIG. 12 is an alternative swaging means for use with the second preferred embodiment of FIGS. 10 and 11.

FIG. 12 illustrates a more economical assembly technique which can be utilized in handles intended for recreational or occasional skiers. In the economy version 200 of FIG. 12, the means for swaging the end portion of elongated member 114 to the end of handle 102 comprises a simple, cylindrical or spherical swage fitting 230 (preferably of steel or aluminum) having a coaxial aperture therethrough sized to pass elongated member 214 therethrough before swaging and a cross-sectional area larger than a transverse hole extending through one side of the handle into the central bore of the handle. In this embodiment, elongated member 214, consisting of a length of stainless steel cable, is inserted through transverse hole 208 and out of the end of handle 202, where swage fitting 230 is slipped over the end 215 of the cable and swaged in place. The cable is then pulled back through aperture 208 until swage fitting 230 is in abutment with an inside wall of handle 202 and the whole assembly encapsulated in foam rubber coating or plastic end cap 224.

Figure 13:
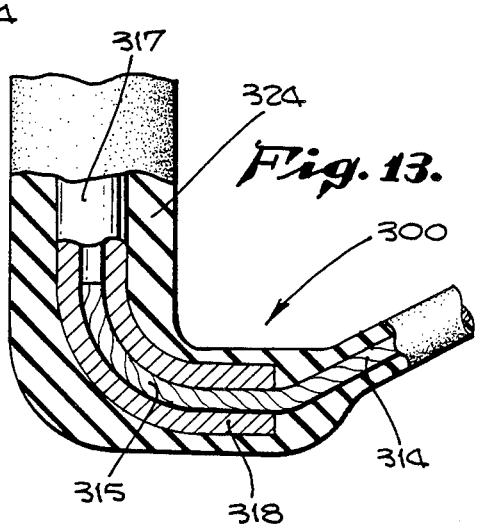
FIG. 13 is a third exemplary embodiment of a handle in keeping with the subject of the present invention.

FIG. 13 illustrates another economical variation on the first preferred embodiment illustrated in FIG. 6. The economy version of FIG. 13 substitutes an enlarged-diameter tube 317 (preferably aluminum) for the solid rod portion 17 of the handle 12 of FIG. 6. End portions 318 are provided with generous radiuses during their deformation to extend transversely to the long axis of the handle and prior to being swaged about end portions 315 of elongated member 314. The assembly is then overcoated with an enhanced thickness of foam rubber coating 324. Dowel 22 fabrication and assembly of the first embodiment is thus eliminated.

Figure 14:
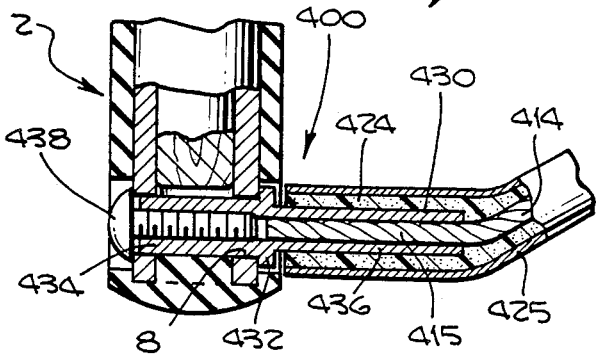
FIG. 14 is yet a fourth embodiment of the bridle of the present invention suitable for provision as a kit for retrofitting an existing handle of the prior art to an improved form.

A kit 400 for retrofitting a conventional handle 2 of the prior art to an improved bridle in keeping with the present invention is illustrated in FIG. 14. Handle 2 typically includes a pair of transverse through holes 8 located at the ends of handle 2 adapted for receiving the ends of a stranded, polypropylene rope. Retro kit 400 comprises a length 414 of flexible, stainless steel cable having a pair of end portions 415 and deformed about a radius at a center portion of the length in an acute angle (not illustrated). A metal cylindrical swage fitting 430 having a cylindrical shoulder 432 disposed between oppositely-directed end portions 434 and 436 has a coaxial bore into either end portion. The internal bore in distal end portion 434 is threaded to receive a threaded fastener, e.g., a cap screw 438, and the other, medial end portion 436 has a smooth bore into which end portion 415 of cable 414 is inserted and swaged. The bridle thus formed may be encapsulated with a foamed rubber down to cylindrical collar 432, or may be encased in a foam rubber casing 424 which is further encapsulated by means of a heat shrunk plastic tubing 425. In order to upgrade a conventional handle 2 into the improved version, the conventional, stranded rope is removed from the transverse holes 8 in handle 2 and the end portion 434 of swage fitting 430 inserted therein. threaded fastener 438 is then screwed into the threaded bore from the other side of the handle and snugged down to pull cylindrical collar 432 into tight engagement with handle 2.

By now, skilled practitioners will recognize that other modifications and materials, methods of fabrication and assembly are possible, depending upon the particular problem at hand. Accordingly, the bridle construction methods and materials illustrated and discussed herein should be taken as exemplary in nature, and the scope and spirit of the instant invention should be limited only by the claims appended hereto.

I claim:

1. A water ski tow bridle, comprising:

a rigid, elongated handle part having a long axis and a pair of oppositely-directed ends and forming the base of an isosceles triangle, said handle part having a pair of transverse holes therethrough, one at either of said ends;

an elongated member forked at a midpoint to define two rearwardly-extending legs of said triangle, each said leg having an end portion;

means for swaging each said end portion of said elongated member to an end of said handle part; and a pair of cylindrical fittings, each having a circumferential collar disposed between oppositely-directed medial and distal end portions, said distal end portion having a threaded coaxial bore therein and extending into one of said transverse holes from one side of said handle part, said threaded bore having a fastener threaded therein from the other side of said handle part to secure said fitting in said handle part, said medial end portion extending transversely outward from said handle part for a short distance and having an axial bore extending thereinto for a short depth, into which said bore one of said elongated member's end portions is inserted with said medial end portion being swaged thereabout.

2. In a water skiing tow handle of the type consisting of an elongated member having a long axis, a pair of oppositely-directed ends, and a pair of generally parallel, transverse holes extending therethrough near said ends, a kit for retrofitting said handle to a ski bridle, comprising:

a length of flexible, stainless steel cable having a pair of ends deformed about a radius at a center portion thereof in an acute angle;

a pair of metal, cylindrical swage fittings, each said fitting having a cylindrical shoulder disposed between oppositely-directed end portions, a distal one of said end portions having a threaded hole extending axially thereinto and being adapted for insertion into one of said transverse holes in said handle from one side of said handle up to said shoulder, the other, medial of said end portions having an axial bore extending thereinto, into which said bore one of said cable ends is inserted, with said distal end portion being swaged thereabout; and a flexible, foamed rubber coating over the entire exterior surface of said cable and said fittings, exclusive of said cylindrical shoulders and distal end portions.

3. The kit of claim 2, further comprising:

a metal cylindrical sleeve about said cable at said center portion thereof, said sleeve and said cable being formed together into the vertex of said acute angle.

4. The kit of claim 2, wherein said cable further comprises:

a closed loop formed into said cable at said midpoint; and means for holding said loop closed.

5. A one-piece water ski tow bridle, comprising:

a length of flexible, stainless steel cable deformed about a radius at a center portion thereof to define two legs of an isoceles triangle, each said leg having an end portion;

a cylindrical sleeve about said cable at said center portion thereof, said sleeve and cable being formed together into the apex of said isoceles triangle;

an elongated metal handle part having a long axis forming the base of said isosceles triangle and a pair of end portions bent parallel to each other and transversely at about right angles to said axis and extending outwardly from said handle part for a short distance, each said end portion having an axial bore extending thereinto into which said bore one of said cable's end portions is inserted, with said handle end portion being swaged thereabout;

a hollow, cylindrical wooden or plastic dowel disposed coaxially about said handle part between said handle part end portions; and a coating of flexible foam rubber or plastic over the entire exterior surface of said bridle.

* * * * *